United States Patent [19]

Crist

[11] Patent Number: 4,512,255

[45] Date of Patent: Apr. 23, 1985

[54] SHEET HANDLING MECHANISM FOR DUPLICATING MACHINE WITH DUPLEXING CAPABILITY

[75] Inventor: Lee D. Crist, Burlingame, Calif.

[73] Assignee: AM International, Chicago, Ill.

[21] Appl. No.: 472,393

[22] Filed: Mar. 4, 1983

[51] Int. Cl.[3] ..... B41F 5/02; B65H 29/00

[52] U.S. Cl. ..... 101/230; 271/186

[58] Field of Search ..... 101/90, 232, 230, 242, 101/420, 183–184; 271/184, 186, 195

[56] References Cited

U.S. PATENT DOCUMENTS

| | | | |
|---|---|---|---|
| 862,330 | 8/1907 | Harris | 271/195 |
| 2,723,119 | 11/1955 | Engebretson et al. | 271/186 X |
| 3,178,174 | 4/1965 | Schneider | 271/195 X |
| 4,019,435 | 4/1977 | Davis | 101/420 X |
| 4,054,285 | 10/1977 | Stange et al. | 271/186 |
| 4,078,789 | 3/1978 | Kittredge et al. | 271/186 X |
| 4,168,830 | 9/1979 | Hori et al. | 271/186 X |
| 4,220,323 | 9/1980 | Smith | 271/186 X |
| 4,365,794 | 12/1982 | Roller | 271/186 |
| 4,405,125 | 9/1983 | Kulpa | 271/195 |

*Primary Examiner*—E. H. Eickholt

*Attorney, Agent, or Firm*—Nicholas A. Camasto

[57] ABSTRACT

A sheet handling mechanism for use in a duplicating machine for duplicating images on both sides of copy sheets including a first printing couple, having an impression cylinder, for transferring a first image to a first side of a copy sheet and a second printing couple for transferring a second image to a second side of the sheet. Mechanism directs each sheet issuing from the impression cylinder in a path away from the first printing couple. Mechanism engages a lead end of each sheet issuing from the directing mechanism and diverts each sheet generally transversely out of the path toward a reversing station. Re-feeding mechanism at the reversing station engages the lead end of the sheet and re-feeds the sheet, trail end first, back into the path whereby the trail end becomes a new lead end of the sheet. Transport mechanism engages the new lead end and transports the sheet toward the second printing couple. A stream of air is directed against the trail end of the sheet as the sheet leaves the diverting mechanism to bias the trail end into engagement with the transport mechanism. The air stream is pulsated in synchronization with issuance of sheets seriatim from the first printing couple whereby air is directed against only the trail end of each sheet as the sheet leaves the diverting mechanism.

10 Claims, 3 Drawing Figures

SHEET HANDLING MECHANISM FOR DUPLICATING MACHINE WITH DUPLEXING CAPABILITY

BACKGROUND OF THE INVENTION

This invention relates generally to a duplicating machine and, more particularly, to a machine for duplicating images on both sides of copy sheets, hereinafter sometimes referred to as "duplexing".

Duplicating machines are available for the production of copies with images formed on one side of the copy sheets. Such equipment can be reliably operated at highly satisfactory production rates. Because of the advantages of duplexing in savings of the amount of paper employed, savings in the space occupied by the copies produced, and savings in production time and equipment costs, it is desirable to provide apparatus for imaging both sides of a copy sheet.

Duplexing often is effected by duplicating machines employing a single printing couple to thereby provide a compact unit that may be utilized in small work areas and conserve the amount of floor space required in which to operate the equipment. However, single printing couples for duplex printing require relatively large and expensive master cylinders, blanket cylinders and impression cylinders because of the multiple images required on a single cylinder. Sometimes the cost is prohibitive. In addition, relatively complex gripper mechanisms are required on the impression cylinder, as well as complex mechanisms for handling sheets released from the impression cylinder and for re-feeding the sheets back to the gripper mechanisms on the cylinder.

Consequently, it is desirable to utilize plural printing couples employing less expensive cylinders and gripper mechanisms where the work area or floor space in which the machine is to be utilized is not a premium.

There have been various approaches in the printing and duplicating field for printing a copy sheet on a first side by a first printing couple and then on the opposite side by a second printing couple. In some instances, the printing couples are arranged in straight-line, tandem. Of course, when the printing couples are arranged in tandem, the overall size of the combined unit is extended considerably thereby requiring additional floor space.

Another approach to duplex printing has been to provide a sheet handling mechanism for passing a copy sheet through a first printing couple for imaging one side of the sheet in a first direction and advancing the sheet in a second, substantially normal direction to a second printing couple. As the sheet changes direction, it is inverted by a turn-over device and simultaneously directed to the second printing couple for imaging the opposite side of the sheet. Such machines are more compact than the tandem arrangement because of the L-shaped configuration of the sheet advancing paths. However, such an arrangement still is considerably more expensive and complex than the simple tandemly arranged printing apparatus.

An area of concentration in reducing the length or overall size of tandemly arranged duplicating machines is in the mechanism for reversing the sheets after receiving the first image at the first printing couple and inverting the sheets for receiving the second image at the second printing couple. Heretofore, mechanical means such as rakes employing mechanical fingers have been utilized to engage the trail ends of copy sheets travelling through the tandem machine, along with other mechanical mechanism, to reverse and invert the sheets. However, such mechanical means have a tendency to break, particularly breakage of the rake fingers, or to become deformed which results in sheet jamming. In addition, complex and expensive mechanical linkage or gear trains are required to drive the sheet handling mechanism in synchronization with the issuing of sheets from the first printing couple.

This invention is directed to solving the sheet handling and reversing problems of the prior art, in duplexing machines of the tandem type employing printing couples in a straight-line arrangement.

SUMMARY OF THE INVENTION

An object, therefore, of the invention is to provide a new and improved device for handling copy sheets for duplexing images in a duplicating machine.

Another object of the invention is to provide a sheet handling mechanism in a duplicating machine employing printing couples arranged in tandem.

A further object of the invention is to provide a sheet handling mechanism of the character described for reversing and inverting copy sheets issuing from the first printing couple of a tandemly arranged duplexing machine.

In the exemplary embodiment of the invention, the sheet handling mechanism is designed for use in a duplicating machine for duplicating images on both sides of copy sheets including a first printing couple, having an impression cylinder, for transferring a first image to a first side of a copy sheet and a second printing couple for transferring a second image to a second side of the sheet. Means are provided for directing each sheet issuing from the impression cylinder in a path away from the first printing couple. Means are provided for engaging a lead end of each sheet issuing from the directing means and diverting each sheet generally transversely out of the path toward a reversing station. Means at the reversing station are provided for engaging the lead end of each sheet and re-feeding the sheet, trail end first, back into the path whereby the trail end becomes a new lead end of the sheet. Means are provided for engaging the new lead end of the sheet and transporting the sheet toward the second printing couple. Means are provided for directing a stream of air against only the trail end of the sheet as the sheet leaves the diverting means to bias the trail end into engagement with the means for transporting the sheet toward the second printing couple.

Means are provided for pulsing the stream of air in synchronization with the issuance of sheets seriatim from the first printing couple, whereby air is directed only against the trail end of each sheet as the sheet leaves the diverting means.

Pulsation of the air stream is effected by an air valve operatively linked to one of the cylinders of the first printing couple, such as the impression cylinder, to synchronize operation of the air valve with rotation of the impression cylinder. The air directing means comprise a perforated tube extending generally parallel to the sheet path and in fluid communication with the air valve.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
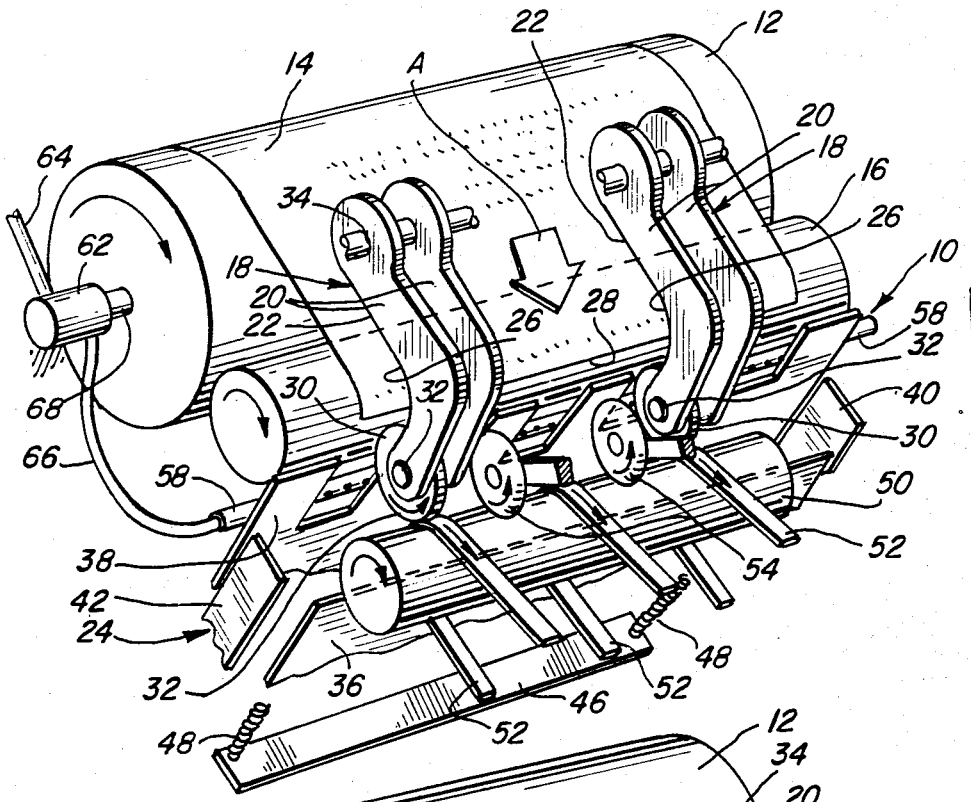
FIG. 1 is a fragmented perspective view of the sheet handling mechanism of the invention in conjunction with an impression cylinder of a printing couple, illustrating a copy sheet issuing from the cylinder.

Referring to the drawings in greater detail, and first to FIG. 1, the sheet handling mechanism of the invention, generally designated 10, is designed for use with a duplicating machine for duplicating images on both sides of copy sheets. The machine includes a first printing couple having an impression cylinder 12 for transferring a first image to a first side of a copy sheet 14. As explained above, the first printing couple is part of a tandemly arranged duplexing machine which includes a second printing couple (not shown) for transferring a second image to a second side of copy sheet 14. The copy sheet is illustrated in FIG. 1 issuing from impression cylinder 10 in a path away from the printing couple as indicated by arrow A.

Means are provided for directing and guiding copy sheets 14 in path A away from impression cylinder 12. In particular, a guide roller 16 is driven by appropriate mechanism in synchronization with impression cylinder 12. A pair of diverting arm assemblies, generally designated 18, each has a pair of diverting arms 20 which are generally L-shaped and define straight edge portions 22 cooperating with guide roller 16 to define sheet path A.

Means are provided for diverting each sheet out of path A toward a reversing station defined by a receiving tray, generally designated 24. In particular, each diverting arm 20 has a curved surface portion 26 formed on a radius corresponding to the radius of guide roller 14. Thus, as sheet 14 issues from impression cylinder 12 and is directed away from the cylinder by guide roller 16 and flat surface portions 22 of diverting arms 20, a lead end 28 of the sheet engages curved surface portions 26 of diverting arms 20 to divert the sheet out of path A and toward receiving tray 24. Idler rollers 30 are rotatably mounted on axles 32 extending between diverting arms 20 of diverting arm assemblies 18. The idler rollers facilitate free movement of the sheet into receiving tray 24. The upper ends of diverting arms 20 are journalled on a common shaft 34 and rest against the cylindrical periphery of guide roller 16 substantially under the weight of the diverting arm assemblies.

Figure 2:
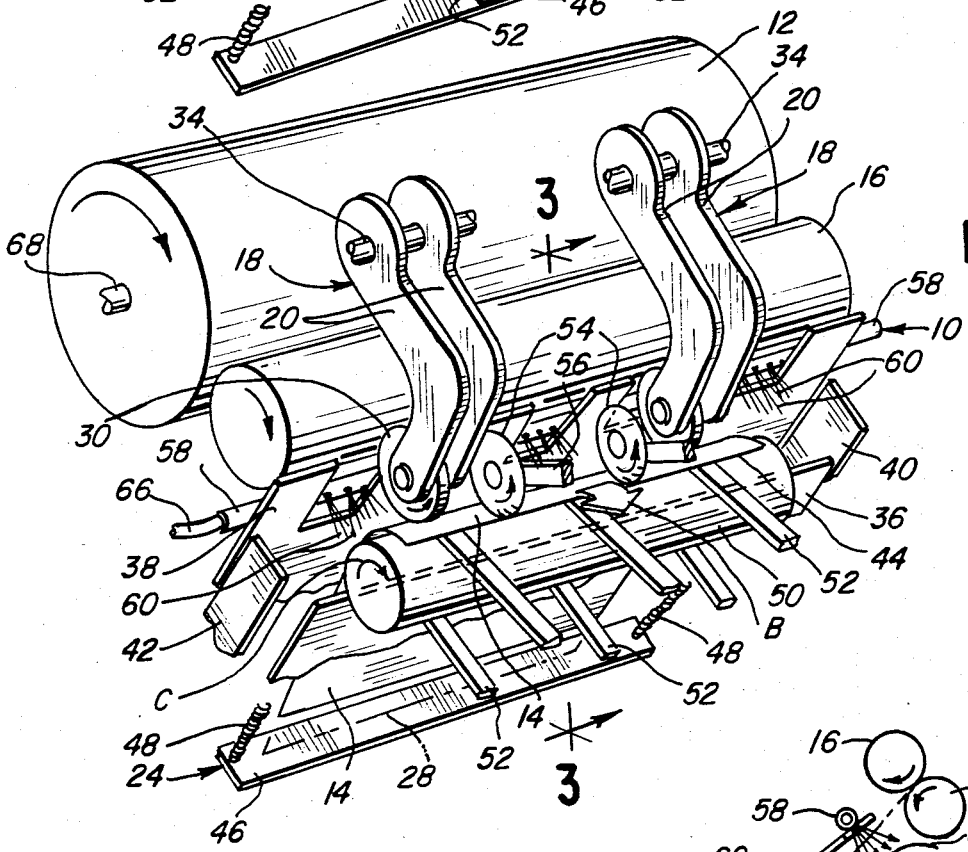
FIG. 2 is a fragmented perspective view similar to that of FIG. 1, illustrating the copy sheet being re-fed back from the reversing station and the air directing means of the invention being actuated.

Receiving tray 24, defining the receiving station, is shown in FIGS. 1 and 2 somewhat exploded and includes a pair of opposite side walls 36 and 38 and a pair of end walls 40 and 42. The receiving tray includes means for re-feeding each sheet 14 back into path A whereby a trail end 44 (FIG. 2) of the sheet becomes a new lead end of the sheet. In particular, a bottom wall 46 of the receiving tray is spring loaded by a pair of compression coil springs 48. As is known in the art, bottom wall 46 is cocked and released by appropriate mechanism driven in synchronization with the first printing couple, including impression cylinder 12, to "kick-back" each copy sheet into path A, with bottom wall 46 engaging lead end 28 of the sheet.

Means are provided for engaging the new lead end (trail end 44) of sheet 14 and transporting the sheet in the direction of arrow B toward a second printing couple (not shown) tandemly arranged in the duplexing machine. The transporting means includes a pair of conveyor rollers 50 (only one shown) rotated in the direction of arrow C and drivingly supporting a plurality of endless belts for transporting the sheet in the direction of arrow B. A pair of idler rollers 54 are journalled on a pair of supporting arms 56 anchored in the machine for directing the new lead end of the sheet onto belts 52.

Means including a perforated tube 58 are provided for directing a stream of air jets 60 (FIG. 2) against the new lead end (trail end 44) of sheet 14 as the sheet leaves diverting arm assemblies 18 to bias the new lead end into engagement with transporting belts 52. In order to avoid affecting lead end 28 of copy sheet 14 as it is diverted into receiving tray 24, means are provided for pulsing the air stream in synchronization with the issuance of sheets seriatim from impression cylinder 12 of the printing couple. FIG. 1 shows one embodiment of a pulsating mechanism which includes an air valve 62 connected by a supply conduit 64 to an appropriate source of air pressure (not shown). An air conduit 66 communicates between air valve 62 and perforated tube 58. The air valve is of known construction and includes interior passageways which are opened and closed by an apertured rotating disc. As used herein, the disc is connected to and rotated by impression cylinder 12 through a shaft 68. With this arrangement, for each revolution of impression cylinder 12 for issuing an individual sheet 14 therefrom, air valve 62 is momentarily opened to cause air under pressure to enter perforated tube 58 to effect directing air streams 60 against trail end 44 of the copy sheet. The air valve is timed to direct a stream of air only against trail end 44 of each copy sheet as the sheet leaves diverting arm assemblies 18. Premature or untimely opening of the air valve could deflect other portions of the sheet, such as lead end 28, and cause undesirable sheet jamming within the sheet handling mechanism.

Figure 3:
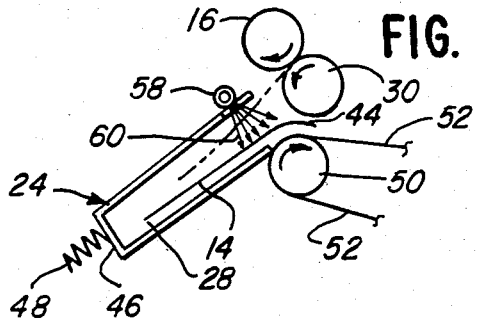
FIG. 3 is a somewhat schematic side elevation, on a reduced scale and taken generally along line 3—3 of FIG. 2, illustrating operation of the air directing means.

FIG. 3 shows somewhat schematically the direction of air stream jets 60 in relation to lead end 28 and trail end 44 of copy sheet 14. Immediately after trail end 44 is biased by the air stream jets against transporting belts 52, "kick-back" bottom wall 46 of reversing tray 24 re-feeds the sheet onto the belts for transport to the second printing couple for duplexing the second image onto the second side of the sheet.

Thus, a new and improved sheet handling mechanism utilizing air direction means is provided in a duplicating machine including a pair of tandemly arranged printing couples for duplexing images on both sides of copy sheets. The sheet handling mechanism is practically trouble-free because of the use of air jets which cannot become broken or deformed as is prevalent with mechanical sheet reversing and inverting mechanisms of the prior art. The jet streams can be actuated in a pulsating manner in synchronization with the printing couple by direct linkage to a cylinder, such as the impression cylinder, of the printing couple.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a duplicating machine for duplicating images on both sides of copy sheets including a first printing couple, having an impression cylinder, for transferring a first image to a first side of a copy sheet and a second printing coupled for transferring a second image to a second side of the sheet, means for handling said sheets for duplexing said images thereon, comprising:

means for directing each sheet issuing from said impression cylinder in a path away from the first printing couple;

means for diverting each sheet out of said path toward a reversing station;

means at the reversing station for re-feeding each sheet back into the path;

means for engaging the sheet and transporting the sheet toward the second printing couple; and means for directing a stream of air in a direction against the plane of the trail end of the sheet as the sheet leaves the diverting means to bias the trail end into engagement with said means for transporting the sheet toward the second printing couple.

2. In a duplicating machine as set forth in claim 1, including means for pulsing said stream of air in synchronization with the issuance of sheets seriatim from the first printing coupled whereby air is directed against only the trail end of each sheet as the sheet leaves the diverting means.

3. In a duplicating machine as set forth in claim 2, including an air valve for effecting pulsation of said air stream.

4. In a duplicating machine as set forth in claim 3, including means operatively linking said air valve with a cylinder of the first printing couple to synchronize operation of the air valve with rotation of said impression cylinder.

5. In a duplicating machine as set forth in claim 4, wherein said air directing means comprises a perforated tube extending generally parallel to said path and in fluid communication with the air valve.

6. In a duplicating machine for duplicating images on both sides of copy sheets including a first printing couple, having an impression cylinder, for transferring a first image to a first side of a copy sheet and a second printing couple for transferring a second image to a second side of the sheet, means for handling said sheets for duplexing said images thereon, comprising:

means for directing each sheet issuing from said impression cylinder in a path away from the first printing couple;

means for engaging a lead end of each sheet issuing from the directing means and diverting each sheet generally transversely out of the path toward a reversing station;

means at the reversing station for engaging the lead end of each sheet and re-feeding the sheet, trail end first, back into the path whereby the trail end becomes a new lead end of the sheet;

means for engaging the new lead end of the sheet and transporting the sheet toward the second printing couple; and means for directing a stream of air in a direction against the plane of only the trail end of the sheet as the sheet leaves the diverting means to bias the trail end into engagement with said means for transporting the sheet toward the second printing couple.

7. In a duplicating machine as set forth in claim 6, including means for pulsing said stream of air in synchronization with the issuance of sheets seriatim from the first printing couple whereby air is directed against only the trail end of each sheet as the sheet leaves the diverting means.

8. In a duplicating machine as set forth in claim 7, including an air valve for effecting pulsation of said air stream.

9. In a duplicating machine as set forth in claim 8, including means operatively linking said air valve with a cylinder of the first printing couple to synchronize operation of the air valve with rotation of said impression cylinder.

10. In a duplicating machine as set forth in claim 9, wherein said air directing means comprises a perforated tube extending generally parallel to said path and in fluid communication with the air valve.

* * * * *